United States Patent [19]

Shaw

[11] Patent Number: 4,951,329

[45] Date of Patent: Aug. 28, 1990

[54] CHILD'S PLAY SHOWER

[75] Inventor: Robert W. Shaw, Piscataway, N.J.

[73] Assignee: Century Products Company, Macedonia, Ohio

[21] Appl. No.: 239,674

[22] Filed: Sep. 14, 1988

[51] Int. Cl.[5] ..... A47K 3/22

[52] U.S. Cl. ..... 4/568; 4/615

[58] Field of Search ..... 4/615–616, 4/569–570, 605

[56] References Cited

U.S. PATENT DOCUMENTS

| | | | |
|---|---|---|---|
| 853,276 | 5/1907 | Viel | 4/567 |
| 950,269 | 2/1910 | Youngs . | |
| 957,566 | 5/1910 | Knickerbocker | 4/616 |
| 1,962,793 | 6/1934 | Vogel | 4/615 X |
| 2,033,023 | 3/1936 | Brown | 4/616 |
| 2,277,562 | 3/1942 | Schu | 4/568 |
| 4,064,570 | 12/1977 | Kim | 4/616 X |

*Primary Examiner*—Charles E. Phillips

*Attorney, Agent, or Firm*—Townsend and Townsend

[57] ABSTRACT

A hand-operated shower head is designed for mounting to the inner wall of a bathtub, with a squeeze pump for drawing water from the bathtub and forcing it up through a length of flexible tubing through a decorative shower head at the top. The device is useful for the amusement of a child while taking a bath.

3 Claims, 2 Drawing Sheets

CHILD'S PLAY SHOWER

This invention relates to devices for children's amusement, and particularly to bath-oriented devices.

BACKGROUND AND SUMMARY OF THE INVENTION

Hand-held shower heads are well known for adult use. An early example of one which is operated by a foot pump rather than water pressure is that disclosed in F. E. Youngs. U.S. Pat. No. 950,269, Feb. 22, 1910.

The present invention resides in a shower head operated by a manual pump, and designed for securement to the interior wall of a bathtub for a child's amusement while bathing. The apparatus is designed to draw water from the bathtub and spray it out through an elevated shower head, all by manual operation by a child, with no danger of excessive water pressure.

DETAILED DESCRIPTION OF THE INVENTION AND PREFERRED EMBODIMENTS

Figure 1:
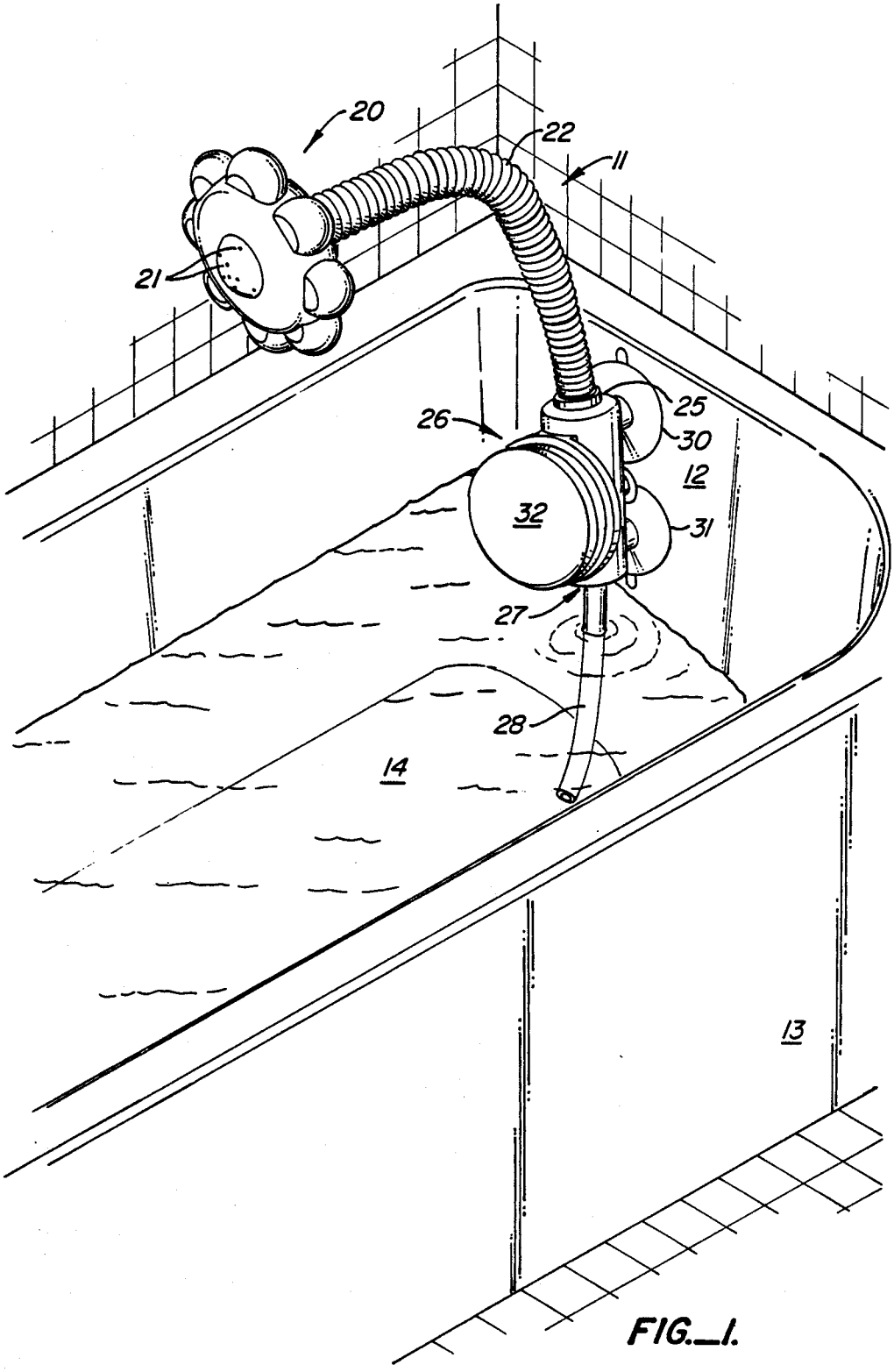
FIG. 1 is a perspective view of one example of a device according to this invention, installed in a bathtub ready for use.

FIG. 1 depicts a manually-operated shower apparatus 11 secured to the inner wall 12 of a bathtub 13. The bathtub is shown partially filled with water 14. The faucet and other normal bathtub fixtures are not shown.

The shower apparatus includes a shower head 20 of a decorative and amusing shape to appeal to a child. The shower head contains holes 21 for water to flow through in the form of a spray when it is forced into the shower head. The shower head is mounted atop a length of tubing 22, which is hollow to permit passage of the water. To permit adjustment of the height of the shower head and the direction of the spray, the tubing is preferably formed of a flexible material, yet one which is sufficiently stiff to be self-supporting. The most appropriate types of tubing will be those which can be bent into close curves without kinking and which can hold their bent form without spring back and yet which can be easily manipulated by hand. Corrugated plastic tubing is one example of such a material. Other examples are well known to those skilled in the art.

The tubing 22 is secured to an outlet port 25 of a squeeze pump 26. The connection is preferably a rotatable connection, such that the shower head can be turned sideways when not in use.

An inlet port 27 on the squeeze pump is connected to a length of intake tubing 28. When the entire device is secured to the inner wall of the tub and the tub is partially filled with water as shown, the intake tubing 28 extends beneath the water level.

A pair of suction cups 30, 31 extending from the back of the squeeze pump 26 serve to affix the squeeze pump to the bathtub wall, and bellows 32 on the front of the squeeze pump provide for its manual operation.

Figure 2:
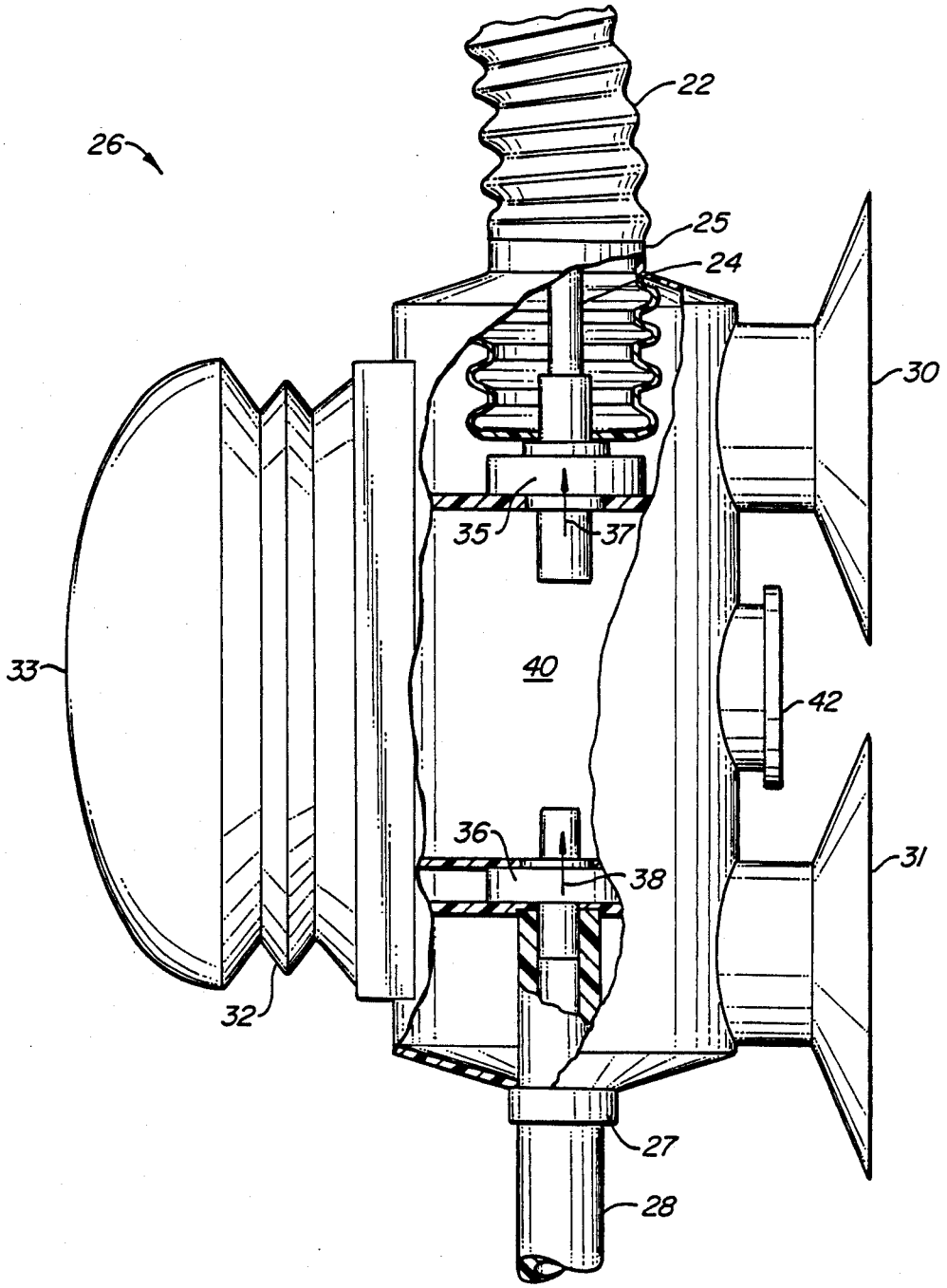
FIG. 2 is an enlarged view of the pump section of the device of FIG. 1, shown in partial cutaway.

The squeeze pump 26 is shown in an enlarged cutaway view in FIG. 2. Here it may be seen that the interior of the squeeze pump is hollow and it is operated by manually pressing on the outward rounded surface 33 of the bellows 22, the bellows being sufficiently resilient to return to its original expanded position upon release. The bellows are shown in this expanded position in FIG. 2.

Control of the intake and outflow of the squeeze pump is achieved by a pair of check valves 35, 36 at the outlet and inlet ends of the squeeze pump, respectively. The check valves are mounted with flow directions parallel, as indicated by the arrows 37, 38, respectively. These check valves may be of conventional construction, such as those widely used in devices of this type, permitting flow in the direction of the arrow only. Thus, upon compression of the bellows 32 by pressure on the outer bellows surface 33, any water or air inside the squeeze pump interior 40 is expelled through the check valve 35 in the direction of the arrow 37, and out the squeeze pump through an inner tube 24 passing through the center of the flexible corrugated tubing 22 and the outer port 25 of the pump. This inner tube carries the water or air directly to the shower head. No air or water flows out the inlet end since it is prevented from doing so by the check valve 36. Upon release of the bellows 32, water is drawn into the squeeze pump through the intake tubing 28 and up through the control valve 36 in the direction of the arrow 38. No air enters from above, since the outlet check valve 35 prevents downward flow.

A squeeze bulb may be used as an alternative to the squeeze pump shown in the drawing.

This device may be used in conjunction with any number of other child s toys designed for bathtub amusement. Examples are floating objects, water wheels and the like.

The embodiment of FIG. 2 also shows a relief valve 42 which can be opened to empty the contents of the squeeze pump in the event that one or both of the check valves becomes clogged or stuck.

The foregoing is offered primarily for purposes of illustration. It will be readily apparent to those skilled in the art that numerous variations and modifications can be made in both the structural and operational elements beyond those described herein without departing from the spirit and scope of the invention.

What is claimed is:

1. A hand-operated child's play shower comprising:

a length of outlet tubing terminating at one end in a shower head of decorative and amusing shape, said outlet tubing being of corrugated plastic that is flexible and self-supporting;

a squeeze pump having a pair of suction cups and a bellows on opposite sides of said pump, said pump further having aligned inlet and outlet ports, said outlet port joined to the other end of said outlet tubing, said squeeze pump further having check valve means constructed and arranged therein to cause ejection of fluid out of said pump through said outlet port when said bellows is squeezed and draw fluid into said pump through said inlet port when said bellows is released; and a length of intake tubing affixed to said inlet port and adapted to extend into a container of water when said pair of suction cups are vertically aligned and attached to the side of said container above said water.

2. A child's play shower in accordance with claim 1 wherein said outlet tubing is rotatably mounted to said outlet port.

3. A child'play shower in accordance with claim 2 and further provided with a relief valve for emptying the contents of said squeeze pump.

* * * * *